US008835781B2

(12) United States Patent
Dixon et al.

(10) Patent No.: US 8,835,781 B2
(45) Date of Patent: Sep. 16, 2014

(54) TOGGLE SWITCH LOCKOUT CLIP AND METHOD

(75) Inventors: Robert D. Dixon, Everett, WA (US); Perry N. Rushton, Orting, WA (US)

(73) Assignee: The Boeing Company, Chicago, IL (US)

( * ) Notice: Subject to any disclaimer, the term of this patent is extended or adjusted under 35 U.S.C. 154(b) by 149 days.

(21) Appl. No.: 13/604,312

(22) Filed: Sep. 5, 2012

(65) Prior Publication Data

US 2014/0061010 A1 Mar. 6, 2014

(51) Int. Cl.
*H01H 9/28* (2006.01)

(52) U.S. Cl.
USPC ..... 200/43.16

(58) Field of Classification Search
CPC ..... H01H 9/286; H01H 9/287; H01H 21/04; H01H 3/20; H01H 9/20; H01H 9/28; H01H 23/00
USPC ..... 200/43.16, 43.14, 43.15, 43.11, 43.19, 200/43.21, 329–332, 339, 302.1, 302.3, 553
See application file for complete search history.

(56) References Cited

U.S. PATENT DOCUMENTS

| | | | | |
|---|---|---|---|---|
| 2,348,393 | A * | 5/1944 | Krieger | 200/334 |
| 5,161,679 | A * | 11/1992 | Russo | 200/43.17 |
| 6,365,851 | B1 * | 4/2002 | Gasper | 200/43.14 |
| 6,930,262 | B2 * | 8/2005 | Lee | 200/43.17 |
| 6,943,310 | B2 | 9/2005 | Eisenhower | |
| 7,964,812 | B1 * | 6/2011 | Schwinn | 200/302.3 |
| 2004/0262138 | A1 | 12/2004 | Lee | |
| 2007/0084705 | A1 | 4/2007 | Marshall | |

FOREIGN PATENT DOCUMENTS

EP 1 164 604 12/2001

OTHER PUBLICATIONS

International Search Report and Written Opinion, PCT/US2013/058312 (2013).

* cited by examiner

*Primary Examiner* — Edwin A. Leon
(74) *Attorney, Agent, or Firm* — Walters & Wasylyna LLC

(57) ABSTRACT

A toggle switch lockout clip including a clip body having a central region and including a latch portion protruding from the central region, the latch portion including an extension member and a hook member connected to the extension member to define a hook gap, a leg portion protruding from the central region away from the latch portion, a first side portion opposed from a second side portion, wherein the first and second side portions extend from the central region and define a gap therebetween, and an engagement portion positioned between the first and second side portions.

17 Claims, 6 Drawing Sheets

TOGGLE SWITCH LOCKOUT CLIP AND METHOD

FIELD

This application relates to toggle switches and, more particularly, to apparatus and methods for securing toggle switches in a desired state.

BACKGROUND

Toggle switches are used to actuate various electrical systems. In one common application, toggle switches are used to power on and off the various control surface electrical systems on an aircraft. For example, prior to controlling the ailerons on an aircraft, the control surface electrical system associated with the ailerons must be powered on by moving the associated toggle switch to the "ON" position.

Referring to FIGS. 1 and 2, a typical toggle switch assembly 10 includes a toggle switch 12, a switch cover 14, a fulcrum 16 and a switch board 18. The toggle switch 12 and the fulcrum 16 are mounted on the switch board 18. The toggle switch 12 is moveable between an "ON" (e.g., forward) position, as shown in FIG. 1, and an "OFF" (e.g., rearward) position, as shown in FIG. 2. The switch cover 14 is pivotally connected to the fulcrum 16, and is moveable between a closed position (FIG. 1) and an open position (FIG. 2). The switch cover 14 is configured to automatically move the toggle switch 12 to the forward "ON" position when the switch cover 14 is moved to the closed position, as shown in FIG. 1. Therefore, the toggle switch assembly 10 is biased to the powered on configuration. To power off the toggle switch assembly 10, a user (e.g., a pilot) must open the switch cover 14 and move the toggle switch 12 to the rearward "OFF" position, as shown in FIG. 2.

During maintenance on an aircraft, the toggle switch assembly 10 is powered off, thereby cutting off power to the associated control surface electrical system. However, if the switch cover 14 is inadvertently moved to the closed position, then power will automatically be restored to the associated control surface electrical system.

Accordingly, those skilled in the art continue with research and development efforts in the field of toggle switches.

SUMMARY

In one embodiment, the disclosed toggle switch lockout clip may include a clip body having a central region and including a latch portion protruding from the central region, the latch portion including an extension member and a hook member connected to the extension member to define a hook gap, and a leg portion protruding from the central region away from the latch portion.

In another embodiment, the disclosed toggle switch lockout clip may include a clip body having a central region and including a latch portion protruding from the central region, the latch portion including an extension member and a hook member connected to the extension member to define a hook gap, a leg portion protruding from the central region away from the latch portion, a first side portion opposed from a second side portion, wherein the first and second side portions extend from the central region and define a gap therebetween, and an engagement portion positioned between the first and second side portions.

In another embodiment, the disclosed toggle switch system may include (1) a toggle switch assembly including a toggle switch and a switch cover moveable between at least a closed position and an open position, wherein the switch cover is positioned over the toggle switch in the closed position, and (2) a toggle switch lockout clip including a clip body having a central region, the clip body including a latch portion protruding from the central region, the latch portion define a hook gap, wherein at least a portion of the switch cover is received in the hook gap, and a leg portion protruding from the central region away from the latch portion.

In yet another embodiment, disclosed is a method for locking out a toggle switch assembly that includes a toggle switch and a switch cover, wherein the toggle switch is moveable between an ON position and an OFF position, and wherein the switch cover is moveable between a closed position and an open position. The method may include the steps of (1) moving the switch cover to the open position and the toggle switch to the OFF position and (2) mounting a clip onto the toggle switch assembly, the clip including a latch portion that latches onto the switch cover and a leg portion that extends away from the latch portion, wherein the clip inhibits movement of the switch cover to the closed position and the toggle switch to the ON position.

Other embodiments of the disclosed toggle switch lockout clip and method will become apparent from the following detailed description, the accompanying drawings and the appended claims.

DETAILED DESCRIPTION

Disclosed is a toggle switch lockout clip that may be mounted on a toggle switch assembly to inhibit (if not eliminate) inadvertent actuation of the toggle switch assembly. When mounted on a toggle switch assembly, the disclosed toggle switch lockout clip may secure the toggle switch of the toggle switch assembly in the "OFF" position and may secure the switch cover of the toggle switch assembly in the open position. As such, actuation of the toggle switch assembly will require the intentional and affirmative step of removing the toggle switch lockout clip prior to actuation.

Figure 3:
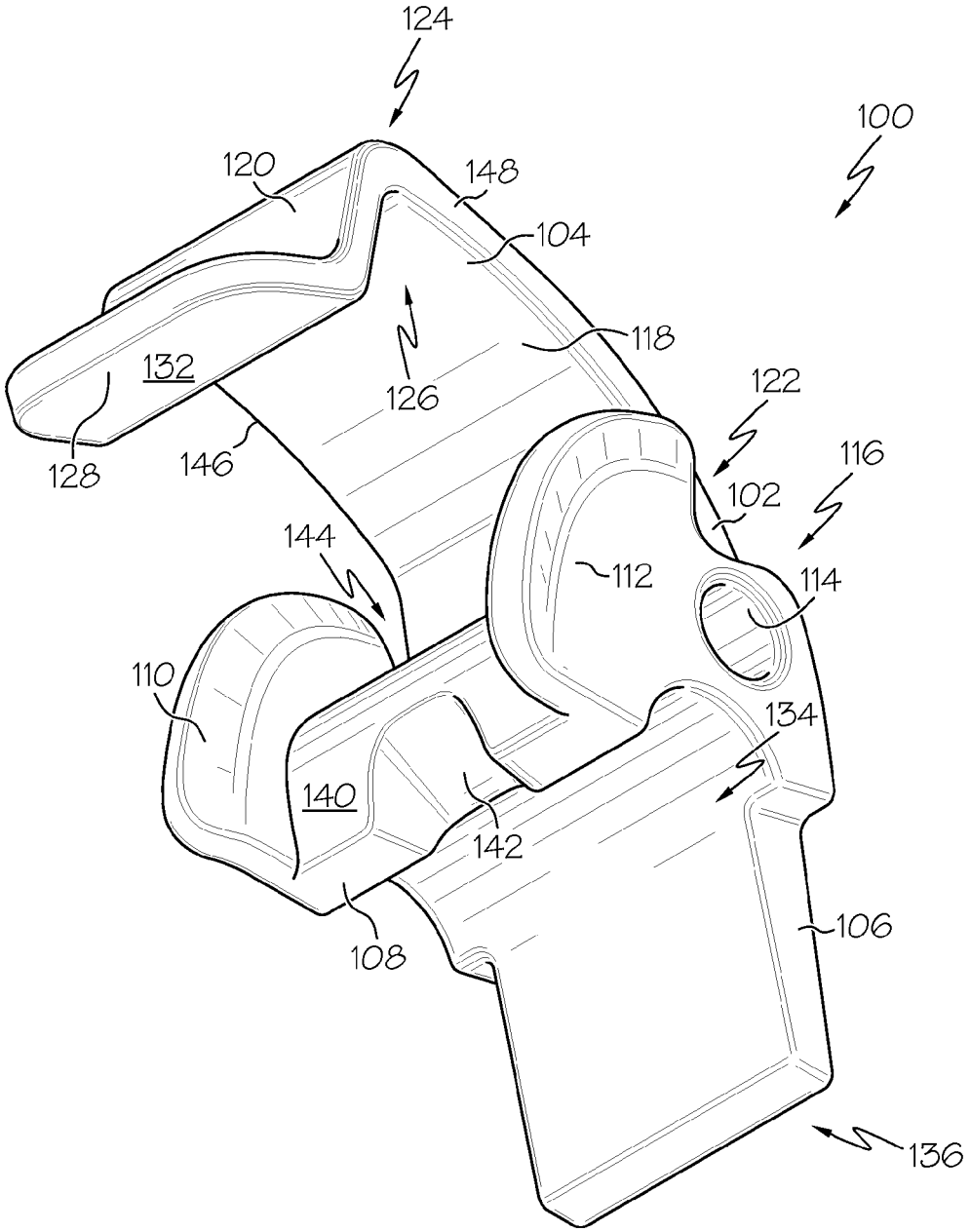
FIG. 3 is a front and side perspective view of one embodiment of the disclosed toggle switch lockout clip.
Figure 4:
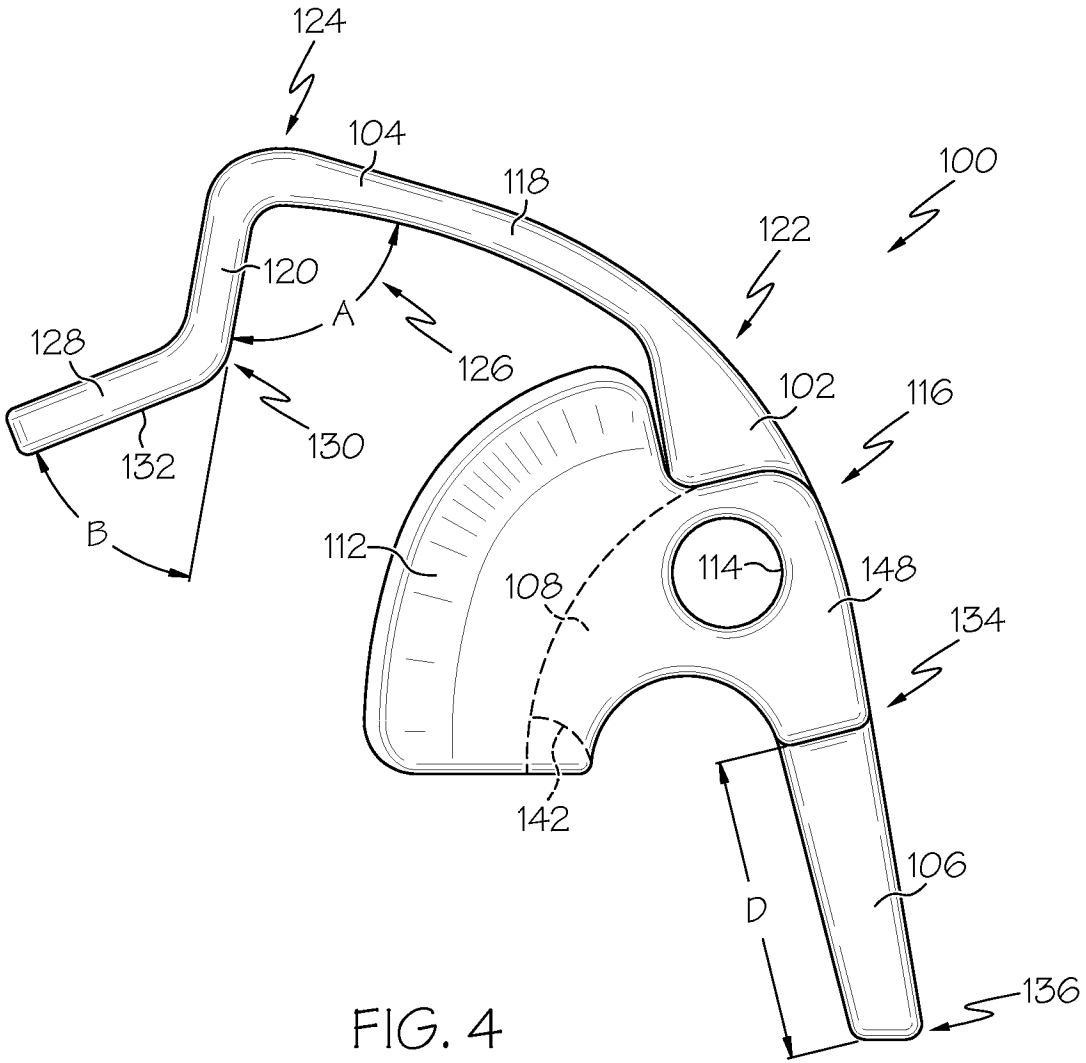
FIG. 4 is a side elevational view of the toggle switch lockout clip of FIG. 3.

Referring to FIGS. 3 and 4, one embodiment of the disclosed toggle switch lockout clip, generally designated 100, may include a clip body 102 having a latch portion 104, a leg portion 106, an engagement portion 108 and side portions 110, 112. Additional components and features, such as a through hole 114, may be included without departing from the scope of the present disclosure.

The clip body 102 may be formed from a semi-rigid, springy yet resilient material to facilitate mounting the toggle switch lockout clip 100 on a toggle switch assembly. As one example, the clip body 102 of the toggle switch lockout clip 100 may be formed from a metal or metal alloy, such as steel. As another example, the clip body 102 of the toggle switch lockout clip 100 may be formed from a polymeric material, such as polycarbonate. As yet another example, the clip body 102 of the toggle switch lockout clip 100 may be formed from a combination of materials.

The clip body 102 of the toggle switch lockout clip 100 may be formed as a single monolithic body (i.e., the latch portion 104, the leg portion 106, the engagement portion 108 and the side portions 110, 112 may be integral). Various forming techniques, such as molding, casting, stamping, fused deposition modeling (e.g., with ABS plastic), selective laser sintering (e.g., nylon) and/or the like, may be used to construct the monolithic clip body 102. Alternatively, the clip body 102 of the toggle switch lockout clip 100 may be formed by connecting together (e.g., with welds, adhesives, mechanical fasteners or the like) one or more portions 104, 106, 108, 110, 112 of the clip body 102.

Figure 5:
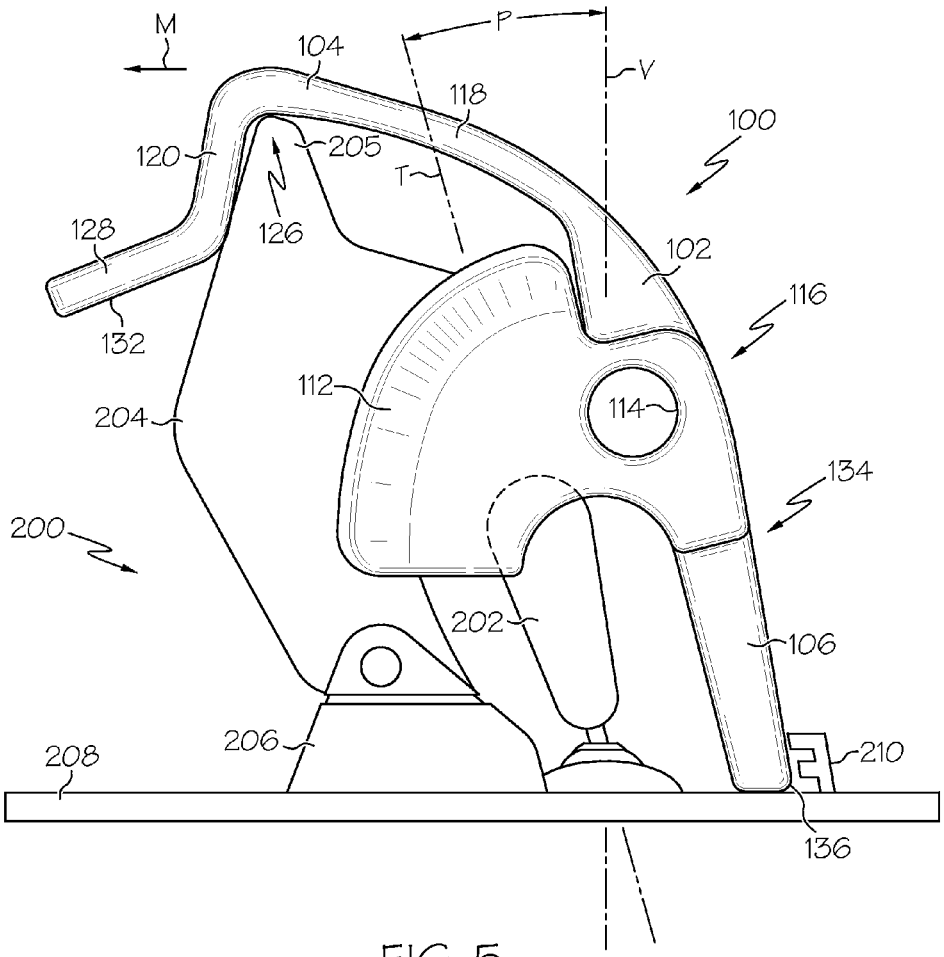
FIG. 5 is a side elevational view of the toggle switch lockout clip of FIG. 4 mounted on, and locking out, a toggle switch assembly.

The latch portion 104 of the clip body 102 may protrude away from the central region 116 of the clip body 102, and may include an extension member 118 and a hook member 120. The extension member 118 may include a proximal end 122 and a distal end 124. The proximal end 122 of the extension member 118 may be positioned proximate (i.e., at or near) the central region 116 of the clip body 102. The hook member 120 may be connected proximate the distal end 124 of the extension member 118, and may be disposed at an angle A relative to the extension member 118. The angle A may open toward the central region 116 of the clip body 102, and may range from about 10 to about 170 degrees, such as from about 45 to about 135 degrees, or from about 70 to about 110 degrees (e.g., about 90 degrees). Therefore, the hook member 120 may define a hook gap 126 between the hook member 120 and the extension member 118 proximate the distal end 124 of the extension member 118. The hook gap 126 may be shaped to closely receive the tip 205 of a switch cover 204, as shown in FIG. 5.

Optionally, a guide tab 128 may extend from the end 130 (FIG. 4) of the hook member 120 of the latch portion 104. The guide tab 128 may be disposed at a non-zero angle B (FIG. 4) relative to the hook member 120, and may include a camming surface 132 that extends toward the hook gap 126 of the latch portion 104. For example, the angle B of the guide tab 128 may range from about 10 to about 180 degrees, such as from about 20 to about 90 degrees, or from about 30 to about 60 degrees (e.g., about 45 degrees).

The leg portion 106 of the clip body 102 may protrude away from the central region 116 of the clip body 102 in a direction generally away from the latch portion 104. The leg portion 106 may include a proximal end 134 and a distal end 136. The proximal end 134 of the leg portion 106 may be positioned proximate the central region 116 of the clip body 102 and the distal end 136 may be spaced a distance D from the proximal end 134. The distance D may define the height of the leg portion 106, and may be dictated by the size and configuration of the toggle switch assembly upon which the toggle switch lockout clip 100 will be mounted, as described in greater detail below.

The engagement portion 108 of the clip body 102 may protrude inward from the central region 116 of the clip body 102 such that the engagement portion 108 is generally between the latch portion 104 and the leg portion 106. The engagement portion 108 may include an engagement surface 140 for engaging (or at least approximating) the toggle switch and switch cover of the toggle switch assembly upon which the toggle switch lockout clip 100 will be mounted, as described in greater detail below. A notch 142 may be formed in the engagement surface 140, and the notch 142 may be contoured to closely correspond to the contour of a portion of the toggle switch (or the switch cover).

The first side portion 110 may be laterally opposed from, and optionally generally parallel with, the second side portion 112. Therefore, the first and second side portions 110, 112 may define a gap 144, and the engagement portion 108 may be positioned in the gap 144 and may laterally extend between the first and second side portions 110, 112. The lateral spacing between the first and second side walls 110, 112 (i.e., the width of the gap 144) may be sufficient to receive at least a portion of the switch cover of the toggle switch assembly upon which the toggle switch lockout clip 100 will be mounted, as described in greater detail below.

Figure 6:
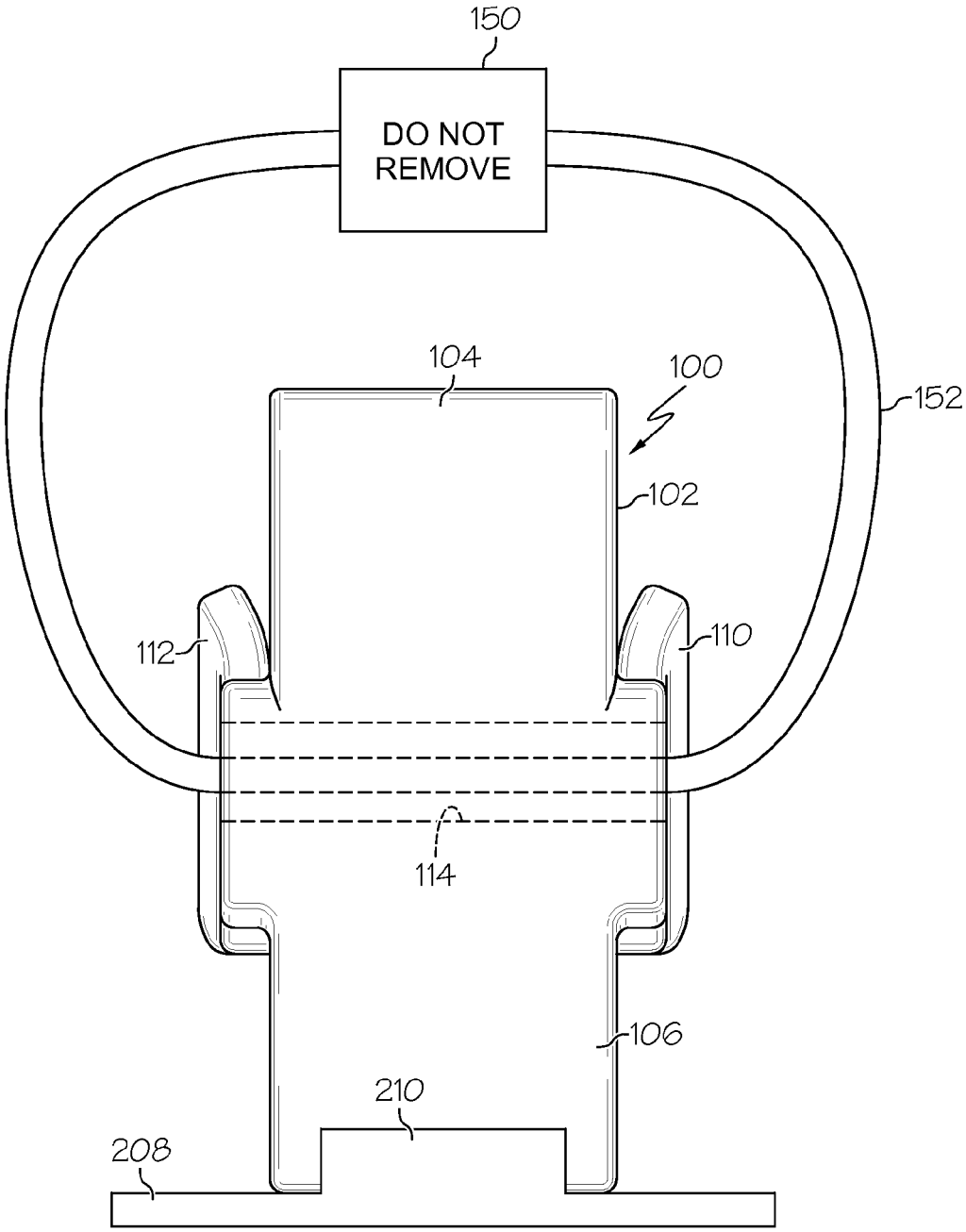
FIG. 6 is a front elevational view of the toggle switch lockout clip and toggle switch assembly of FIG. 5, shown with a tag connected to the toggle switch lockout clip.

The central region 116 of the clip body 102 may define the through hole 114. The through hole 114 may laterally extend through the clip body 102 from a first side 146 of the clip body 102 to a second side 148 of the clip body 102. Therefore, as shown in FIG. 6, a tag 150 may be connected to the toggle switch lockout clip 100 by passing through the through hole 114 in the switch body a tether 152 (e.g., a pin, a cord, a wire, a clip, a lock or the like) connected to the tag 150. The tag may include indicia, such as written text (e.g., "Do Not Remove"), color (e.g., the color red) and/or graphics, warning others not to remove or otherwise tamper with the toggle switch lockout clip 100.

Referring now to FIG. 5, the disclosed toggle switch lockout clip 100 may be mounted on a toggle switch assembly 200 to inhibit (if not eliminate) inadvertent actuation of the toggle switch assembly 200. While one particular toggle switch assembly (assembly 200) is described below, those skilled in the art will appreciate that the disclosed toggle switch lockout clip 100 may be configured for use on various toggle switch assemblies without departing from the scope of the present disclosure.

Figure 1:
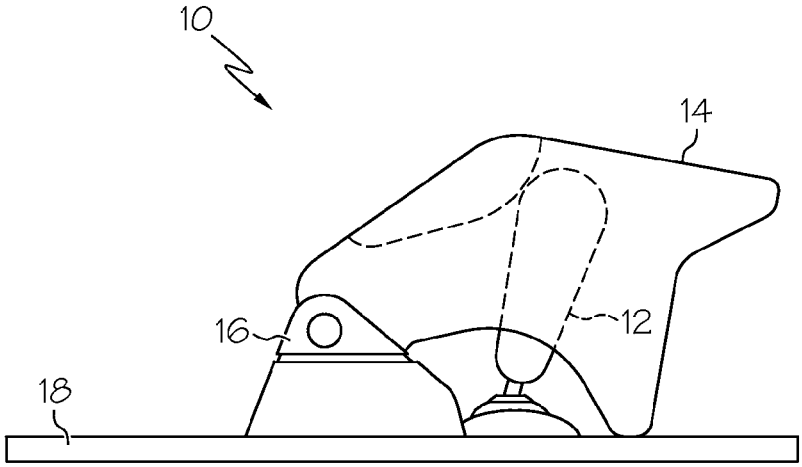
FIG. 1 (PRIOR ART)
FIG. 1 is a side elevational view of a prior art toggle switch assembly.
Figure 2:
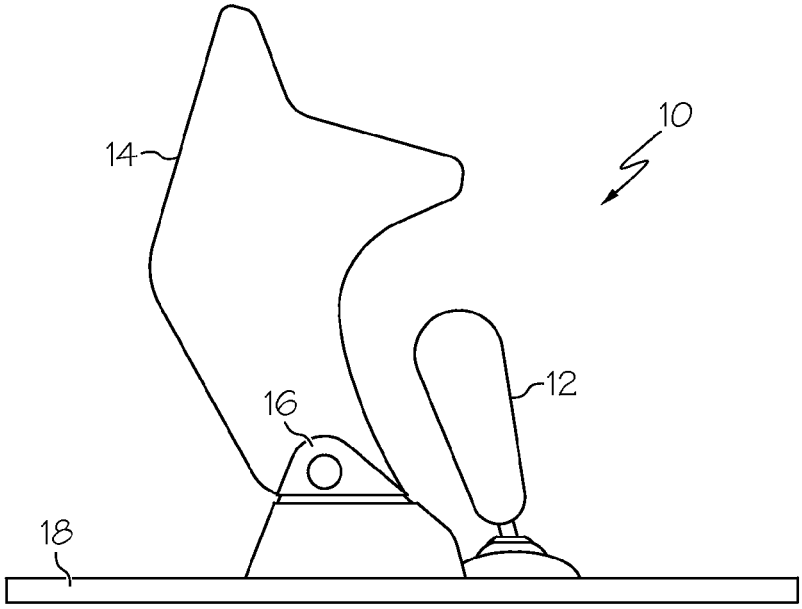
FIG. 2 (PRIOR ART)
FIG. 2 is a side elevational view of the toggle switch assembly of FIG. 1, shown in a powered off configuration.

The toggle switch assembly 200 may include a toggle switch 202, a switch cover 204, a fulcrum 206, a switch board 208 and, optionally, a stop 210. The toggle switch 202, the fulcrum 206 and the stop 210 may be mounted on the switch board 208. The toggle switch 202 may be moveable at least between an "ON" position (see FIG. 1) and an "OFF" position. In the "OFF" position, the toggle switch 202 may in a rearward position wherein the axis T of the toggle switch 202 is at an angle P (e.g., about 5 to about 45 degrees) relative to the vertical axis V.

The switch cover 204 may be pivotally connected to the fulcrum 206, and may be moveable between a closed position (see FIG. 1) and an open position. With the switch cover 204 in the open position, the toggle switch 202 may be moved to the rearward (i.e., "OFF") position.

With the toggle switch assembly 200 in the "OFF" configuration (e.g., the switch cover 204 open and the toggle switch 202 in the rearward position), the toggle switch lockout clip 100 may be mounted on the toggle switch assembly 200 as described below. Other techniques for mounting the toggle switch lockout clip 100 on the toggle switch assembly 200 are also contemplated.

First, the leg portion 106 of the clip body 102 may be placed on the switch board 208 such that the distal end 136 of the leg portion 106 is positioned between the toggle switch 202 and the optional stop 210. When the toggle switch lockout clip 100 is fully mounted, the distal end 136 of the leg portion 106 may abut the optional stop 210.

Next, the toggle switch lockout clip 100 may be aligned with the toggle switch 202 and the switch cover 204 of the toggle switch assembly 200. Specifically, the toggle switch lockout clip 100 may be aligned such that the engagement portion 108 (FIGS. 3 and 4) of the clip body 102 is in alignment with the toggle switch 202 and the gap 144 between the first and second side portions 110, 112 is aligned to receive a portion of the switch cover 204.

With the leg portion 106 on the switch board 208 and the toggle switch lockout clip 100 aligned, the latch portion 104 of the clip body 102 may be urged in the direction shown by arrow M. As the latch portion 104 moves in the direction of arrow M, the tip 205 of the switch cover 204 may cam along the camming surface 132 of the guide tab 128 until the tip 205 of the switch cover 204 is positioned in the hook gap 126 between the hook member 120 and the extension member 118 of the latch portion 104.

The mounting process may be complete once the latch portion 104 of the toggle switch lockout clip 100 is properly latched onto the switch cover 204 of the toggle switch assembly 200. Forming the clip body 102 from a springy, resilient material may facilitate the process of latching the latch portion 104 onto the switch cover 204.

Accordingly, once the toggle switch lockout clip 100 is mounted on the toggle switch assembly 200, the toggle switch lockout clip 100 may secure the toggle switch 202 in the "OFF" position and may secure the switch cover 204 in the open position. Specifically, once the toggle switch lockout clip 100 is mounted on the toggle switch assembly 200, the engagement portion 108 (FIGS. 3 and 4) of the toggle switch lockout clip 100 may protrude toward the toggle switch 202 and the switch cover 204 of the toggle switch assembly 200 to create an interfering obstruction that may inhibit movement of the toggle switch 202 to the "ON" position and that may inhibit movement of the switch cover 204 to the closed position.

Figure 7:
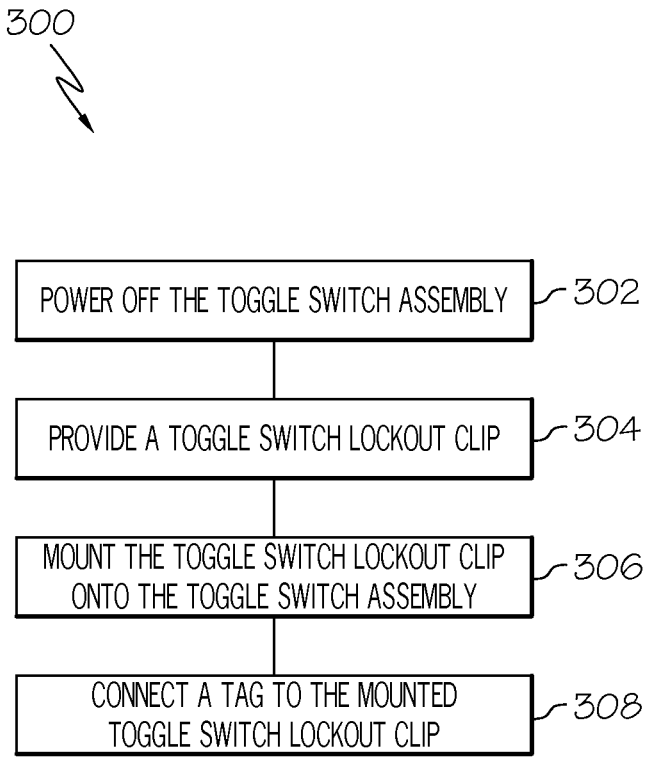
FIG. 7 is a flow chart outlining one embodiment of the disclosed method for locking out a toggle switch assembly.

Also disclosed is a method for locking out a toggle switch assembly that includes a toggle switch and a switch cover. One embodiment of the disclosed method is shown in FIG. 7 and is generally designated 300.

The method 300 may begin at Block 302 with the step of powering off the toggle switch assembly. For example, powering off the toggle switch assembly may require (1) opening the switch cover and (2) moving the toggle switch to the rearward "OFF" position.

At Block 304, a toggle switch lockout clip may be provided. The toggle switch lockout clip may include a latch portion, a leg portion and an engagement portion. Optionally, the toggle switch lockout clip may also include side portions for receiving the switch cover and a through hole for connecting a tag to the toggle switch lockout clip.

At Block 306, the toggle switch lockout clip may be mounted onto the toggle switch assembly. The mounting process may include latching the latch portion onto the switch cover of the toggle switch assembly to approximate the engagement portion of the toggle switch lockout clip with the toggle switch and the switch cover of the toggle switch assembly.

At Block 308, a tag may be connected to the toggle switch lockout clip mounted on the toggle switch assembly. The tag may include indicia, such as written text (e.g., "Do Not Remove"), color (e.g., the color red) and/or graphics, advising others not to remove the toggle switch lockout clip.

Accordingly, the disclosed toggle switch lockout clip and method may inhibit (if not eliminate) inadvertent actuation of a toggle switch assembly.

Although various embodiments of the disclosed toggle switch lockout clip and method have been shown and described, modifications may occur to those skilled in the art upon reading the specification. The present application includes such modifications and is limited only by the scope of the claims.

What is claimed is:

1. A toggle switch lockout clip comprising:

a clip body having a central region defining a through hole, said clip body comprising:

a latch portion protruding from said central region, said latch portion comprising an extension member and a hook member connected to said extension member to define a hook gap;

a leg portion protruding from said central region away from said latch portion;

a first side portion opposed from a second side portion, wherein said first and said second side portions extend from said central region and define a gap therebetween;

an engagement portion positioned between said first and said second side portions; and a tag connected to said clip body by a tether extending through said through hole.

2. The toggle switch lockout clip of claim 1 wherein said clip body is formed as a single, monolithic body.

3. The toggle switch lockout clip of claim 1 wherein said clip body if formed from a resilient material.

4. The toggle switch lockout clip of claim 1 wherein said tag is marked with warning indicia.

5. The toggle switch lockout clip of claim 1 wherein said hook member is connected to said extension member at an angle ranging from about 45 to about 135 degrees.

6. The toggle switch lockout clip of claim 1 wherein said latch portion further comprises a guide tab connected to said hook member.

7. The toggle switch lockout clip of claim 1 wherein said engagement portion comprises an engagement surface, and wherein a notch is formed in said engagement surface.

8. A toggle switch system comprising:

a toggle switch assembly comprising:

a toggle switch; and a switch cover, wherein said switch cover is in an open position, and wherein said switch cover is moveable from said open position to a closed position, said switch cover being positioned over said toggle switch in said closed position; and a toggle switch lockout clip comprising a clip body having a central region, said clip body comprising:

a latch portion protruding from said central region, said latch portion define a hook gap, wherein at least a portion of said switch cover is received in said hook gap; and a leg portion protruding from said central region away from said latch portion.

9. The toggle switch system of claim 8 wherein said leg portion protrudes into engagement with said toggle switch assembly.

10. The toggle switch system of claim 8 wherein said toggle switch assembly further comprises a stop, and wherein said leg portion is positioned between said toggle switch and said stop.

11. The toggle switch system of claim 8 wherein said toggle switch lockout clip further comprises a first side portion opposed from a second side portion, wherein said first and said second side portions extend from said central region and define a gap therebetween, at least a portion of said switch cover being received in said gap.

12. The toggle switch system of claim 8 wherein said toggle switch lockout clip further comprises an engagement portion protruding into engagement with said toggle switch.

13. The toggle switch system of claim 12 wherein said engagement portion inhibits movement of said switch cover to said closed position.

14. The toggle switch system of claim 8 wherein said toggle switch lockout clip inhibits movement of said switch cover to said closed position.

15. The toggle switch system of claim 8 further comprising a tag connected to said toggle switch lockout clip.

16. The toggle switch system of claim 15 wherein said clip body defines a through hole, and wherein said tag is connected to said toggle switch lockout clip by a tether that extends through said through hole.

17. A method for locking out a toggle switch assembly that includes a toggle switch and a switch cover, said toggle switch being moveable between an ON position and an OFF position, said switch cover being moveable between a closed position and an open position, said method comprising the steps of:

moving said switch cover to said open position and said toggle switch to said OFF position;

mounting a clip onto said toggle switch assembly, said clip comprising a latch portion that latches onto said switch cover and a leg portion that extends away from said latch portion, wherein said clip inhibits movement of said switch cover to said closed position and said toggle switch to said ON position.

* * * * *